US005871372A

United States Patent [19]

Kanda et al.

[11] Patent Number: 5,871,372

[45] Date of Patent: Feb. 16, 1999

[54] STRUCTURE FOR ELECTRICALLY CONNECTING AN ANNULAR CORRUGATED TUBE

[75] Inventors: Takayoshi Kanda; Nobuyoshi Matsuda, both of Hyogo-ken, Japan

[73] Assignee: Mitsubishi Cable Industries, Ltd., Hyogo-ken, Japan

[21] Appl. No.: 583,711

[22] Filed: Jan. 5, 1996

[30] Foreign Application Priority Data

Jan. 12, 1995 [JP] Japan ..... 7-003099

[51] Int. Cl.[6] ..... H01R 17/04

[52] U.S. Cl. ..... 439/583; 439/610

[58] Field of Search ..... 439/583, 584, 439/578, 610, 98

[56] References Cited

U.S. PATENT DOCUMENTS 4,995,832 2/1991 Thommen et al. ..... 439/583

*Primary Examiner*—Carl E. Hall

[57] ABSTRACT

Electrical connection of an annular corrugated tube having an outer surface shape wherein grooves and ridges are alternately repeated in the axial direction of the tube in a wave form is carried out by cutting the tube at a groove, disposing a clamping member on each side of a ridge at the cut end of the tube and electrically connecting the tube to the clamping member positioned on the cut end of the tube side of the ridge by squashing the ridge with the clamping members.

15 Claims, 4 Drawing Sheets

STRUCTURE FOR ELECTRICALLY CONNECTING AN ANNULAR CORRUGATED TUBE

BACKGROUND OF THE INVENTION

1. Field of the Invention

This invention relates to a method and structure for electrically connecting an annular corrugated tube, and more particularly for example to a method and structure for electrically connecting a coaxial cable having an outer conductor with an annular corrugated outer surface as an annular corrugated tube when the end of the outer conductor is clamped by clamping members.

2. Description of the Related Art

Referring to FIG. 5, when a coaxial cable 100 is to be connected to an antenna or the like, a connector 50 is usually attached to its end. The coaxial cable 100 comprises an annular corrugated outer conductor 101 formed as an annular corrugated tube. Here, for the convenience of the following description, the concave portions of the outer conductor 101 will be referred to as grooves and the convex portions will be referred to as ridges. Accordingly, the outer conductor 101 has the shape of a tube wherein grooves and ridges are alternately periodically repeated in the axial direction of the tube. An inner conductor 102 having the shape of a straight pipe is disposed inside the outer conductor 101 coaxially therewith. An insulator 103 for electrically insulating the two conductors from each other is filled between the two conductors 101, 102. A corrosion prevention layer 104 for preventing corrosion of the coaxial cable 100 covers the outside of the outer conductor 101.

The connector 50 connected to the end of the coaxial cable 100 comprises a gripping flange 51, a connector proper 52, a connecting metal 53, an insulator 54, a contact 55, a support member 56 and a split clamp 57.

By the coaxial cable 100 being connected to the connector 50, the end of the outer conductor 101 is clamped by the support member 56 and the split clamp 57 and the outer conductor 101 of the coaxial cable 100 is electrically connected to the connector 50. Therefore, it is necessary that the end of the outer conductor 101 be clamped by the support member 56 and the split clamp 57. However, because the outer surface of the outer conductor 101 of the coaxial cable 100 is ridged and the pitch at which the grooves and ridges constituting the annular corrugated form are repeated is relatively long, the angle of slope of the ridges is also gentle.

Consequently, when the end of the outer conductor 101 has not undergone any preparatory treatment, the work of clamping the end of the coaxial cable 100 with the support member 56 and the split clamp 57 is not always easy.

As a result, conventionally, to facilitate this clamping, the end of the outer conductor 101 has been widened radially outward. When it has been widened radially outward, the end of the outer conductor 101 can be easily clamped between the support member 56 and the split clamp 57.

However, with this kind of conventional connection, the work of widening the end of the outer conductor 101 radially outward is time and labor consuming. Also, a specialized and costly tool is necessary for widening the end of the outer conductor 101. Furthermore, in order to widen the end of the outer conductor 101 radially outward it is necessary to cut the outer conductor 101 along a ridge using a cutting blade, and a complicated and expensive tool including members for guiding the cutting blade along the ridge is required for this.

Thus with an annular corrugated tube like the outer conductor described above it is costly and not easy to clamp the end of the tube to a connecting member such as a connector with clamping members.

SUMMARY OF THE INVENTION

Accordingly, it is a main object of the invention to make it possible, without widening the end of the annular corrugated tube radially outward, to easily form at the end of the tube a connection part to be clamped when the tube is electrically connected.

Another object of the invention is to make it possible without cutting a ridge part of the annular corrugated tube to easily form a connection part to be clamped when the tube is electrically connected.

A further object of the invention is to provide a new method and structure for connecting a coaxial cable using an annular corrugated tube.

Other and further objects, features and advantages of this invention will appear more fully from the following description.

In this invention, electrical connection of an annular corrugated tube having an outer surface shape wherein grooves and ridges are alternately repeated in the axial direction of the tube in a wave form is carried out by cutting the tube at a groove, disposing clamping members on each side of a ridge at the cut end of the tube and electrically connecting the tube to the clamping member positioned on the cut end of the tube side of the ridge by squashing the ridge with the clamping members.

The number of ridges squashed may be more than one, but the squashing can be carried out easily if only the first ridge is squashed.

As the ridged tube, one of which the ratio of the depth of the grooves to the pitch of the ridges is 1.0:2.0 to 2.5, that is, one of which the width of the ridges is considerably lower than that of a normal annular corrugated tube (of which the same ratio is 6.0) and the surfaces of the side walls of the ridges are steep is used. By using an annular corrugated tube having ridges of this kind of shape, squashing of a ridge can be easily carried out with a small force. (The above-mentioned groove depth is the distance from the peak of a ridge to the bottom of a groove.)

Cutting of the annular corrugated tube is carried out using a cutting blade only one side of the cutting edge of which has a sloping surface. In this way, by using a cutting blade having a cutting edge sharper than when a cutting blade having sloping surfaces on both sides of the cutting edge is used, cutting can be carried out more easily.

The invention also employs the electrical connection described above for a method for connecting a coaxial cable, and in this case the annular corrugated tube is an outer conductor of a coaxial cable and the clamping member positioned on the cut end of the annular corrugated tube side of the ridge is a part of connector attached to the end of the coaxial cable; here, the clamping member on the opposite side of the ridge from the cut end of the annular corrugated tube is a split clamp fitted on the annular corrugated tube.

The invention also provides a structure for electrically connecting an annular corrugated tube comprising: an annular corrugated tube having an outer surface shape wherein grooves and ridges are alternately repeated in the axial direction of the tube in a wave form and having one end cut at a groove; clamping members which are disposed on each side of the first ridge from the cut end of the annular corrugated tube; and a clamping member moving member for making the clamping members move toward each other, wherein by an operation of the clamping member moving member causing the clamping members to squash the first ridge the annular corrugated tube is electrically connected to the clamping member positioned on the cut end of the annular corrugated tube side of the ridge. The invention also provides a structure for connecting a coaxial cable employing this structure for electrically connecting an annular corrugated tube.

In this structure for connecting a coaxial cable, squashing of a ridge of an outer conductor of a coaxial cable is effected by a cap nut screwed into a part of a connector being tightened. By this construction being adopted, by a ridge being squashed as the cap nut is tightened during connection of the coaxial cable to the connector, at the same time a connection part of the outer conductor is formed and therefore the work of separately squashing a ridge is eliminated.

Also, the end of an inner conductor of the coaxial cable projects beyond the end of the outer conductor, an inner conductor connecting and fitting part for connecting and fitting with the inner conductor is provided inside the connector and by the end of the inner conductor engaging with the inner conductor connecting and fitting part as the outer conductor is connected with the connector the outer conductor and the inner conductor are connected simultaneously.

BRIEF DESCRIPTION OF THE DRAWINGS

The accompanying drawings, which are incorporated in and form a part of this specification, illustrate embodiments of the invention and together with the description serve to explain the principles of the invention.

In the drawings:

FIG. 2(*b*) is a side sectional view of a main part of a coaxial cable according to a preferred embodiment of the invention illustrating removal of an insulator exposed by the cutting of an outer conductor;

DETAILED DESCRIPTION OF THE PREFERRED EMBODIMENTS

Figure 1:
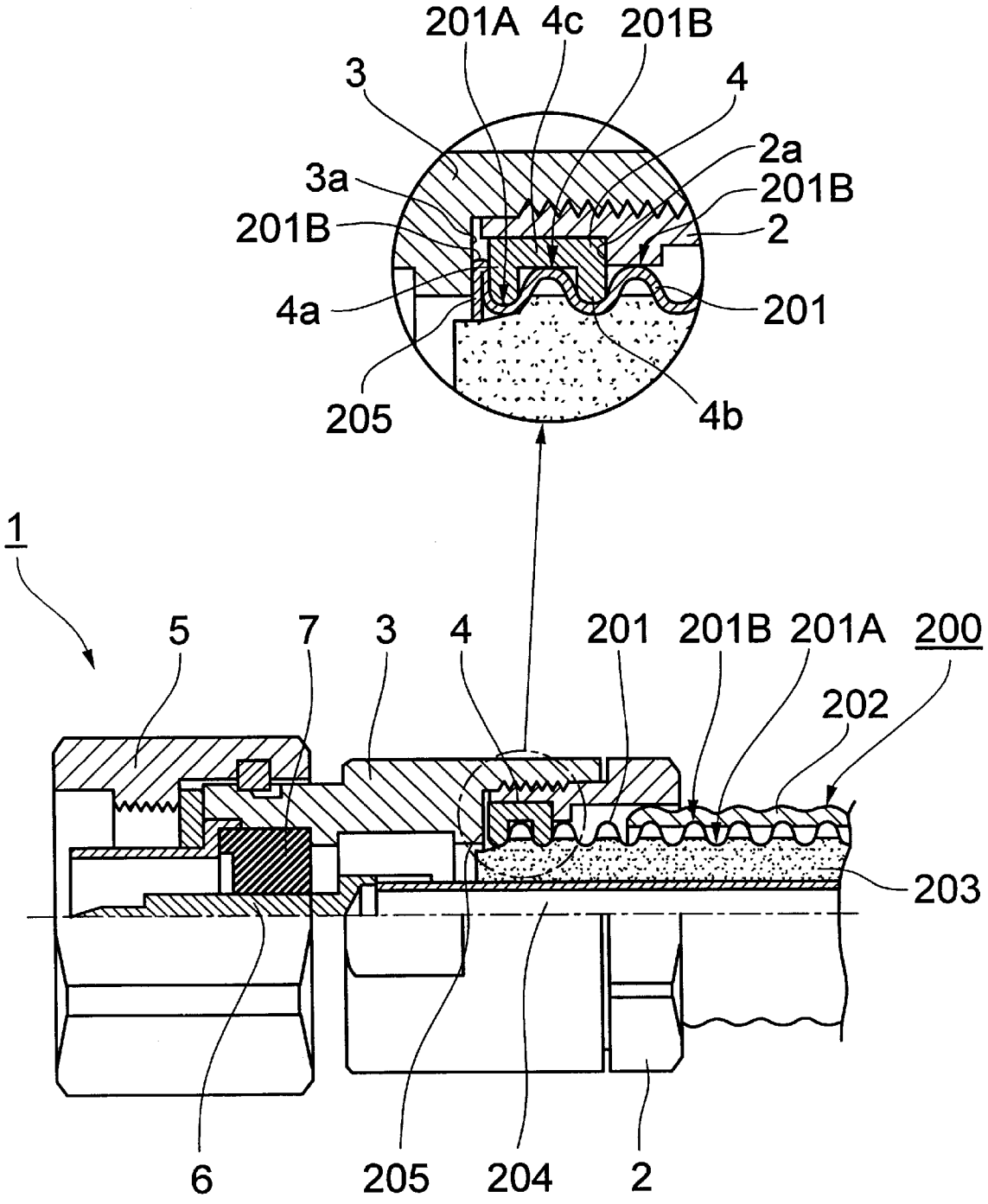
FIG. 1 is a plan view of a connecting structure of a coaxial cable with a connector according to a preferred embodiment of the invention.

Referring to FIG. 1, a coaxial cable 200 has as an annular corrugated tube an outer conductor 201 with ridges 20/B on its outer surface. A corrosion preventing layer 202 is formed on the outer surface of the outer conductor 201. An insulator 203 is formed on the inner surface side of the outer conductor 201. An inner conductor 204 is disposed inside the insulator 203. The outer conductor 201 and the inner conductor 204 are electrically insulated from each other by the insulator 203. The outer conductor 201 as seen from outside is formed as an annular corrugated tube wherein grooves 201A and ridges 201B are alternately repeated.

As the outer conductor 201 used in this preferred embodiment, for example one of which the internal diameter at the grooves 201A is 9.3 mm, the pitch of the ridges 201B is 3.0 mm and the depth of the grooves is 1.3 mm is used. That is, the width of the ridges 201B is small and the side wall surfaces thereof are steep.

The following preparation of the coaxial cable 200 is carried out before it is connected to a connector 1: The end of the coaxial cable 200 is treated to make it straight over a predetermined length suited to the axial direction dimensions of the connector 1, for example about 100 mm. The corrosion preventing layer 202 constituting the outermost layer of the coaxial cable 200 and consisting of for example polyethylene is cut circumferentially and removed over a predetermined length from the end of the coaxial cable 200. The position of the cut end of the corrosion preventing layer 202 is so set that it is aligned with a central position of one of the grooves 201A of the outer conductor 201. The length of the corrosion preventing layer 202 so peeled off is determined according to the axial dimensions of the connector 1.

Figure 2A:
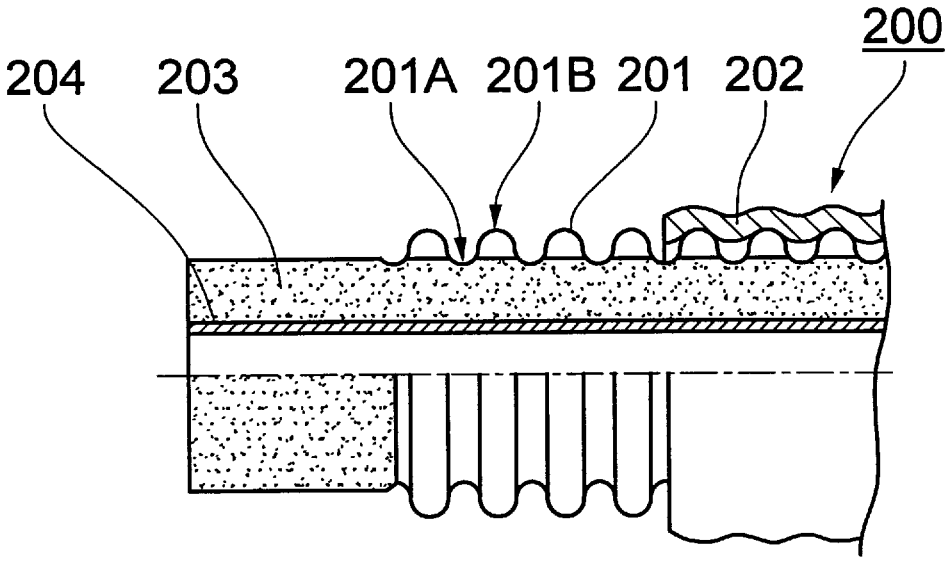
FIG. 2(*a*) is a side sectional view of a main part of a coaxial cable according to a preferred embodiment of the invention illustrating a process of cutting an outer conductor of the coaxial cable.
Figure 2B:
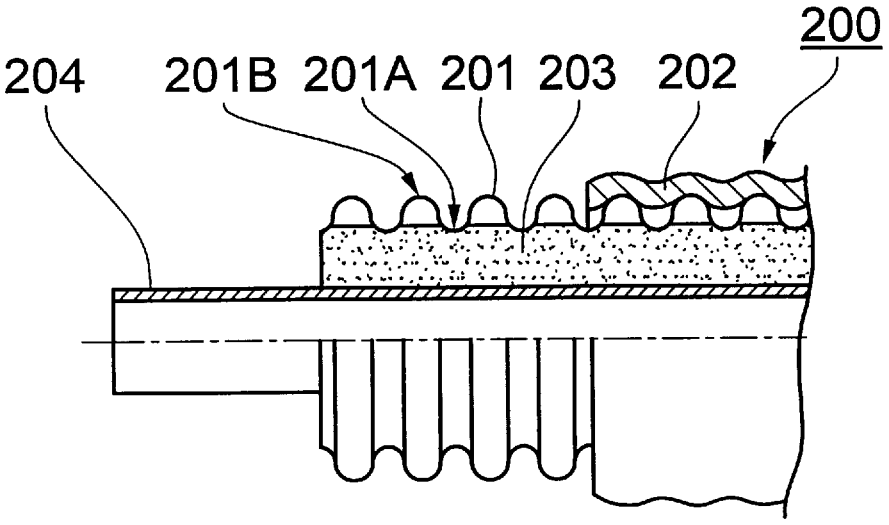

After the corrosion preventing layer 202 is thus peeled off, the outer conductor 201 is cut from the end of the coaxial cable 200 over a predetermined length suited to the axial dimensions of the connector 1, for example 8 to 9 mm, the cutting being carried out at one of the grooves 201A in a predetermined position. This cut state is shown in FIG. 2(*b*).

The insulator 203 exposed as a result of this cutting is removed. As a result of the removal of this insulator 203 the inner conductor 204 is exposed as shown in FIG. 2(*b*). The exposed inner conductor 204 is chamfered using a flat file.

Figure 3:
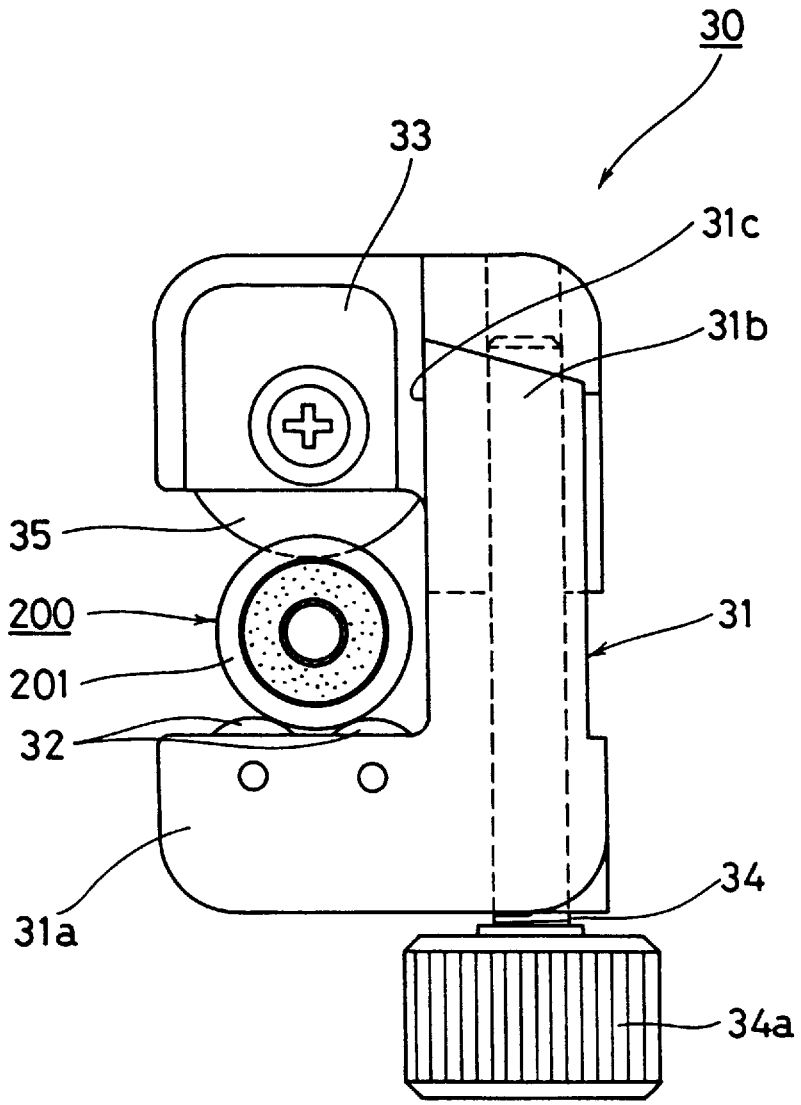
FIG. 3 is a plan view showing the structure of a cutting tool according to a preferred embodiment of the invention used for cutting a coaxial cable.
Figure 4:
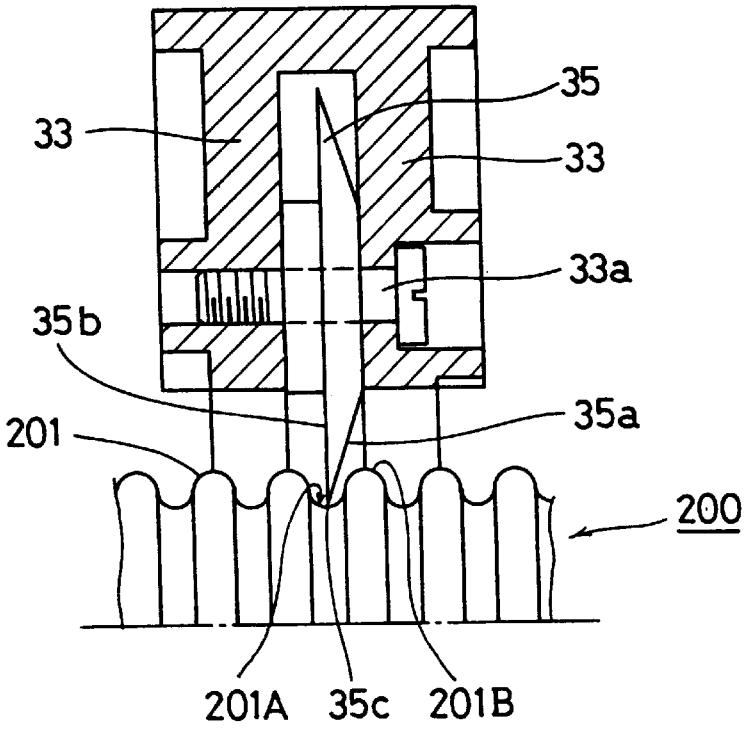
FIG. 4 is a side view of a main part of the same cutting tool.
Figure 5:
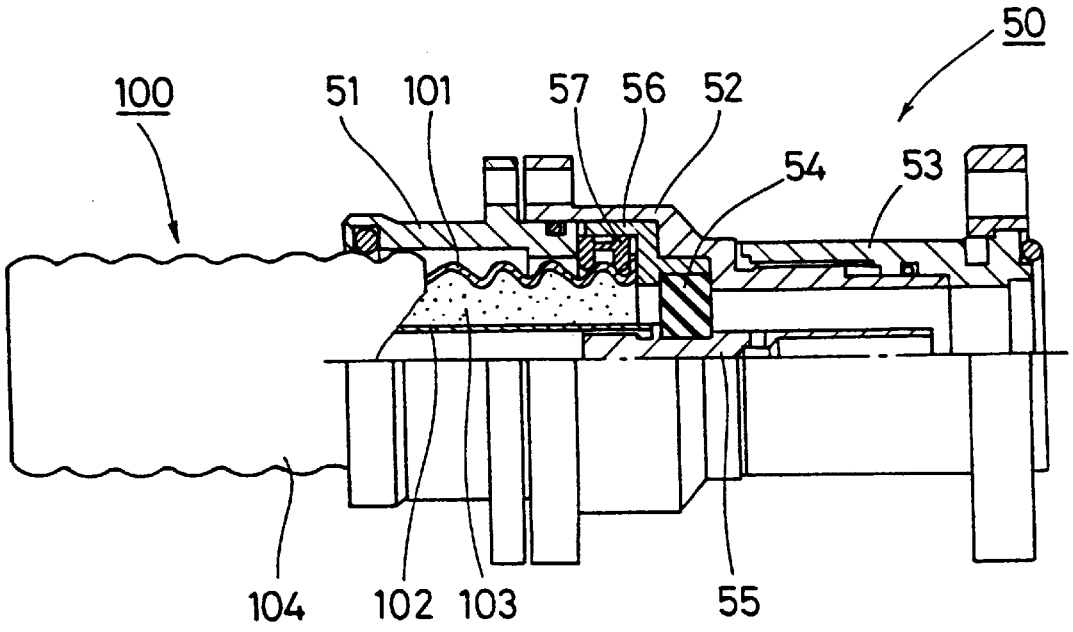
F I G. 5 PRIOR ART
FIG. 5 is a side view with the upper half partly cut away showing a conventional connection between a coaxial cable and a connector.

The method by which the outer conductor 201 is cut will now be described. Cutting of the outer conductor 201 is carried out using a cutting tool 30 shown in FIG. 3 and FIG. 4.

The construction of the cutting tool 30 will now be described. The cutting tool 30 has an L-shaped support member 31. A pair of guide rollers 32, 32 are mounted on one end 31*a* of the support member 31 a predetermined distance apart from each other. A pair of holding members 33, 33 are mounted on the other end 31*b* of the support member 31. The pair of holding members 33, 33 face each other across a predetermined gap with a rotary shaft 33*a* mounted therebetween. The pair of guide rollers 32, 32 and the pair of holding members 33, 33 are disposed facing each other across a predetermined vertical gap in front of an inner side surface 31*c* of the support member 31. A feed screw 34 serving as a relative movement mechanism is rotatably housed inside the end 31*b* of the support member 31. The pair of holding members 33, 33 are movable by this feed screw 34 in the length direction of the end 31*b* of the support member 31, i.e. the direction in which the holding members 33, 33 face the guide rollers 32, 32. A disc-shaped cutting blade 35 is rotatably mounted on the rotary shaft 33*a* between the holding members 33, 33. As a result, the cutting blade 35 faces the pair of guide rollers 32, 32. The rotary shaft 33*a* on which the cutting blade 35 is mounted and rotary shafts not shown in the drawings on which the pair of guide rollers 32, 32 are mounted are parallel with each other and with the thickness direction of the support member 31, i.e. a direction perpendicular to the paper surface.

A characteristic feature of the cutting tool 30 is the structure of the cutting blade 35. That is, of the two sides of the cutting edge 35*c* of the cutting blade 35, one cutting edge side 35*a* is sloping with respect to the radial direction of the cutting blade 35 and the other cutting edge side 35*b* is perpendicular to the axial direction of the cutting blade 35.

In cutting the outer conductor 201 of the coaxial cable 100 using this cutting tool 30, first, to make it possible to position the coaxial cable 200, the feed screw 34 is operated and the pair of holding members 33, 33 are moved in advance as far away from the guide rollers 32, 32 as they will go. The coaxial cable 200 with the corrosion preventing layer 202 already peeled off and the outer conductor 201 thereby exposed is then positioned between the cutting blade 35 and the guide rollers 32, 32. During this positioning the cutting blade 35 is brought into line with a groove 201A at a predetermined position. The feed screw 34 is then operated and the cutting blade 35 is moved toward the guide rollers 32, 32. Simultaneously with this movement, the position of the cutting tool 30 is finely moved in the axial direction of the coaxial cable 200 until the cutting edge side 35*b* of the cutting edge 35*c* of the cutting blade 35 almost abuts with the side wall surface of the ridge 201B adjacent to the groove 201A of the outer conductor 201 on the same side of the groove 201A as the axial center of the coaxial cable 200, that is, on the right side thereof in FIG. 4. When this is being done, because as described above the cutting edge side 35*b* is perpendicular to the axial direction of the cutting blade 35, the cutting blade 35 can be moved in the axial direction of the coaxial cable 200 until the cutting edge 35*c* of the cutting blade 35 is positioned at the side wall of the ridge 201B.

A knob 34*a* attached to the feed screw 34 is then further turned to rotate the feed screw 34 and cause the cutting blade 35 to cut to some extent into the surface of the groove 201A of the outer conductor 201 in said predetermined position. The outer conductor 201 is then cut by the cutting tool 30 in this state being rotated about the coaxial cable 200 by hand. This turning of the cutting blade 35 is carried out by hand as described above, but because the guide rollers 32, 32 rotate relative to the circumference direction of the outer conductor 201 and the cutting blade 35 also rotates along the outer surface of the outer conductor 201, even with a relatively small force it is possible to rotate the coaxial cable 200 easily by hand.

In this way, the cut position of the outer conductor 201 cut from the coaxial cable 200 is not the middle of the groove 201A of the predetermined position but is a position near the ridge 201B adjacent to the groove 201A on the same side thereof as the axial center of the coaxial cable 200.

The coaxial cable 200 having had its end prepared as described above is connected to the connector 1 as described below with reference to FIG. 1. The connector 1 comprises a cap nut 2 serving as a clamping member moving member fitting on the outside of the connection end of the coaxial cable 200 and a main body 3 serving as one clamping member connected by a screw thread to the cap nut 2. A split clamp 4 serving as another clamping member is disposed between the cap nut 2 and the main body 3. The split clamp 4 is made up of a clamping part 4*a*, a pushed-upon part 4*b* and a joining part 4*c* joining these together. A coupling nut 5 is rotatably mounted on the outside of the main body 3. A central connector 6 is mounted inside the main body 3 with an insulator 7 disposed therebetween. A side of the central connector 6 to which the inner conductor 204 is connected constitutes a tubular part 208, and a plurality of slits 209 are formed in the tubular part 208 in the axial direction. The provision of these slits 209 make it possible for the tubular part 208 to widen; by widening, the tubular part 208 firmly holds the inner conductor 204 when it is fitted into the tubular part 208, and in this way electrical connection of the inner conductor 204 to the central connector 6 is stably effected. As a result of having the constitution described above the split clamp 4 has an inner surface shape which covers one of the ridges 201B of the outer conductor 201 of the coaxial cable 200, and the split clamp 4 is made up of a pair of circular arc shaped ringlike members not fully shown in the drawings fitting around the outside of the outer conductor 201 and a member which with the ringlike members positioned around the outer surface of one of the ridges 201B of the outer conductor 201 holds the ringlike members together on the outer surface of the ridge 201B as a split clamp.

Connection of the coaxial cable 200 using the connector 1 will now be described.

With the coaxial cable 200 inserted into the connector 1 through an opening in the main body 3, the split clamp 4 is fitted onto a second ridge of the ridges 201B of the outer conductor 201. This second ridge is the second ridge from the end of the coaxial cable 200. The cap nut 2 is then screwed into the main body 3 so that the split clamp 4 fitted over a ridge 201B of the outer conductor 201 is clamped from both sides. By this screwing action the split clamp 4 is clamped between a receiving seat 2*a* provided on the cap nut 2 and a receiving seat 3*a* provided on the main body 3. By tightening the cap nut 2 the split clamp 4 is moved toward the left in FIG. 1, and as a result of this a first ridge of the plural ridges 201B of the outer conductor 201 is clamped between the split clamp 4 and the receiving seat 3*a* of the main body 3 and as this clamping force increases the ridges is squashed into a flange shape. This squashing of the first ridge of the plurality of ridges 201B is effected smoothly with a small force because the width of the first ridge is small and the side wall surfaces of the ridges are steep.

In this way, the outer conductor 201 of the coaxial cable 200 is firmly electrically and mechanically connected to the connector 1 by way of the main body 3. Also, simultaneously with this connection of the outer conductor 201, the inner conductor 204 fits into the tubular part 208 of the central connector 6 and connection of the inner conductor 204 is also effected. Thus, connection of the outer conductor 201 and the inner conductor 204 to the connector 1 is performed easily just by tightening the cap nut 2.

The outer conductor 201 of the coaxial cable 200 is connected to the connector 1 in this way, and at the time of this connection the first ridge of the plurality of ridges 201B at the end of the outer conductor 201 is squashed and becomes a flange portion 205 and the outer conductor 201 is connected to the connector 1 by way of this flange portion 205. Therefore, the work of widening the end of the outer conductor 201 radially outward as has been done conventionally becomes unnecessary. The flange portion 205 is automatically created when the cap nut 2 and the main body 3 of the connector 1 are joined together.

In this point, the work of connecting the connector 1 to the coaxial cable 200 is greatly reduced compared to a conventional case. Labor costs are also reduced as a result of this reduction in the connection work. Furthermore, because a special tool for widening the end of the outer conductor 201 radially outward becomes unnecessary, tooling costs can also be reduced.

Also, because cutting of the outer conductor 201 is carried out at a groove 201A, compared to when cutting of a ridge is carried out, because guiding members and the like not necessary, the cutting work is simple and cutting costs can be reduced.

In particular, because the cutting position of the outer conductor 201 is a position near a ridge 201B, even if this ridge 201B is squashed as described above, the cut end of the outer conductor 201 is not positioned further on the radially inner side of the coaxial cable 200 than a groove 201A. Therefore, even after the ridge 201B of the outer conductor 201 is squashed, the separation distance between the outer conductor 201 and the inner conductor 204 at the cut end of the outer conductor 201 remains substantially the same as the separation distance between the outer conductor 201 and the inner conductor 204 elsewhere in the cable, and high frequency transmission path impedance fluctuation caused by variations in this separation distance is suppressed.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A structure for electrically connecting an annular corrugated tube comprising:

an annular corrugated tube having an outer surface shape wherein grooves and ridges are alternately repeated in the axial direction of the tube in a wave form and having one end cut at a groove;

clamping members which are disposed on each side of a first ridge from the cut end of the annular corrugated tube, the first ridge having first and second outer portions; and a moving member for the clamping members for causing the clamping members to move toward each other, wherein operation of the moving member causes the clamping members to squash the first ridge causing the first outer portion to physically contact a clamping member, so that the annular corrugated tube is electrically connected to the clamping member positioned on the cut end of the tube side of the ridge.

2. The structure for electrically connecting a coaxial cable according to claim 1, wherein the annular corrugated tube is an outer conductor of a coaxial cable and the clamping member positioned on the cut end of the tube side of the ridge is a part of a connector attached to the end of the coaxial cable.

3. The structure for electrically connecting a coaxial cable according to claim 2 wherein a clamping member positioned on the opposite side of the ridge from the cut end of the annular corrugated tube is a split clamp attached to the annular corrugated tube.

4. The structure for electrically connecting a coaxial cable according to claim 1 wherein the moving member for the clamping members is a cap nut screwed to a part of the connector.

5. The structure for electrically connecting a coaxial cable according to claim 2 wherein the end of an inner conductor of the coaxial cable projects beyond the end of the outer conductor and an inner conductor connecting and fitting part to which the inner conductor fits is provided inside the connector and when the outer conductor is connected to the connector the end of the inner conductor is fitted to the inner conductor connecting and fitting part.

6. The structure for electrically connecting a coaxial cable according to claim 2 wherein the moving member for the clamping members is a cap nut screwed to a part of the connector.

7. The structure for electrically connecting a coaxial cable according to claim 3 wherein the moving member for the clamping members is a cap nut screwed to a part of the connector.

8. The structure for electrically connecting a coaxial cable according to claim 1, wherein one of the clamping members and the moving member for the clamping members are threadably engaged with each other.

9. The structure for electrically connecting a coaxial cable according to claim 8 wherein the moving member for the clamping members has an exterior located thread and a clamping member has an interior located thread.

10. The structure for electrically connecting a coaxial cable according to claim 2, wherein there is an inner conductor and the ridge that is squashed defines a flange having an end portion extending toward the inner conductor.

11. The structure for electrically connecting a coaxial cable according to claim 1, wherein one clamping member is located between a seat portion on the interior of a second clamping member and a seat portion on the interior of the clamping member's moving member.

12. The structure for electrically connecting an annular corrugated tube according to claim 1, wherein the first ridge is a squashed ride having the first and second outer portions.

13. The structure for electrically connecting an annular corrugated tube according to claim 12, wherein the first outer portion is in physical contact with the clamping member positioned on the cut end of the tube side of the ridge.

14. The structure for electrically connecting an annular corrugated tube according to claim 13, wherein the second outer portion is physically connected to a split clamp attached to the annular corrugated tube.

15. The structure for electrically connecting an annular corrugated tube according to claim 14, wherein the squashed ridge has a first and second interior surface in physical contact with each other.

* * * * *